United States Patent [19]

Nakamura et al.

[11] Patent Number: 4,737,248

[45] Date of Patent: Apr. 12, 1988

[54] PROCESS FOR PRODUCING DYSPROSIUM-IRON ALLOY AND NEODYMIUM-DYSPROSIUM-IRON ALLOY

[75] Inventors: Eiji Nakamura, Aichi; Katsuhisa Itoh, Nagoya; Masahiro Nishio, Tajimi; Mikio Sakakibara, Chiryu, all of Japan

[73] Assignee: Sumitomo Light Metal Industries, Ltd., Tokyo, Japan

[21] Appl. No.: 941,040

[22] Filed: Dec. 12, 1986

[30] Foreign Application Priority Data

Dec. 19, 1985 [JP] Japan ..... 60-286170
Mar. 24, 1986 [JP] Japan ..... 60-65300

[51] Int. Cl.[4] ..... C25C 3/36
[52] U.S. Cl. ..... 204/71
[58] Field of Search ..... 204/64 R, 71, 245

[56] References Cited

U.S. PATENT DOCUMENTS 1,196,699 8/1916 Keyes et al. ..... 204/64 R
3,524,800 8/1970 Morrice et al. ..... 204/71
3,586,013 6/1971 Stewart ..... 204/64 R
3,928,935 12/1975 Henrie et al. ..... 204/1.5

FOREIGN PATENT DOCUMENTS 0177233 4/1986 European Pat. Off. .

OTHER PUBLICATIONS

"Fused Salt Electrowinning—of Rare Earths–" Morrie et al, Minerals Sci., vol. 11, #3, Jul. 1979, pp. 125–136.
"Direct Electrolysis of Rare-Earth Oxides to Metals and Alloys in Fluoride Melts", Bureau of Mines, Report of Investigations, 7146 (1968).

*Primary Examiner*—R. L. Andrews
*Attorney, Agent, or Firm*—Parkhurst & Oliff

[57] ABSTRACT

A process and an apparatus for producing a dysprosium-iron alloy or a neodymium-dysprosium-iron alloy by electrolytic reduction of dysprosium fluoride or neodymium fluoride and dysprosium fluoride in a bath of molten electrolyte, consisting essentially of 20–95% by weight of dysprosium fluoride or a mixture of neodymium fluoride and dysprosium fluoride, 5–80% by weight of lithium fluoride, up to 40% by weight or barium fluoride and up to 20% by weight of calcium fluoride, conducted between one or more iron cathode and one or more carbon anode. The apparatus comprises an electrowinning cell of refractory materials coated inside with a lining resistive to the bath, the carbon anode of constant transverse cross-sectional shape over its length, immersed in the electrolyte bath at its free end, the iron cathode of constant transverse cross-sectional shape over its length, immersed in the electrolyte bath at its free end, a receiver placed on the bottom of the cell for collecting the produced dysprosium-iron alloy or neodymium-dysposium-iron alloy in a liquid state on the tip of the iron cathode, siphoning means for withdrawing the molten alloy pooled in the receiver out of the cell, and feeding means for feeding the iron cathode into the electrolyte bath so as to apply the direct current to the iron cathode with a predetermined current density.

14 Claims, 2 Drawing Sheets

PROCESS FOR PRODUCING DYSPROSIUM-IRON ALLOY AND NEODYMIUM-DYSPROSIUM-IRON ALLOY

BACKGROUND OF THE INVENTION

1. Field of the Art

The present invention relates to a process and apparatus for producing a dysprosium-iron alloy and a neodymium-dysprosium-iron alloy. More particularly, it relates to a process of continuously producing a dysprosium-iron alloy of high dysprosium content and a neodymium-dysprosium-iron alloy of high dysprosium and neodymium content, both of which can be advantageously used as an alloying material for producing a high-quality permanent magnet of rare earth metal, iron and boron, because of their freedom from harmful impurities and non-metallic inclusions.

2. Related Art Statement

Dysprosium (Dy) is advantageously used as an alloying material for a recently developed high-quality permanent magnet made of neodymium, dysprosium, iron and boron, for the purpose of increasing its magnetic coercive force (a Japanese laid-open patent application: TOKU-KAI-SHO-60 No. (1985)-32306 can be referred). It is therefore expected that the demand for dysprosium will be increased in future. Although metallic dysprosium can be added to the magnet with some effect, a dysprosium-iron alloy is preferable to metallic dysprosium, in respect of handling for addition to the magnet, since metallic dysprosium has a comparatively high melting point, 1409° C. Further, a dysprosium-transition metal (e.g., iron) alloy is now under review, for use as a material for magnetooptical disks.

A neodymium-dysprosium-iron alloy is advantageous for use as the alloying material for such a permanent magnet, if the composition of the alloy has a constant ratio of neodymium to dysprosium. Since neodymium and dysprosium are simultaneously introduced into the permanent magnet by use of the neodymium-dysprosium-iron alloy, the manufacturing cost of the permanent magnet is decreased.

Four processes, which are commonly known in the art, of manufacturing an alloy of a rare earth metal and a high-melting-point metal are described below. All of them can, however, not be satisfactory, because of containing some inherent disadvantages or problems, as the practical and industrial process operable continuously.

(A) A method wherein rare earth metal or its alloy is prepared beforehand by means of electrowinning the same in a bath of electrolyte or by means of reducing a rare earth compound with an active metal, and the obtained rare earth or its alloy is melted together with another metal for alloying them:

The method, however, is problematical in the first step of preparing the rare earth or its alloy. In the electrowinning method, two techniques can be named as a prior art: Electrolysis is an electrolyte bath of fused chlorides (raw materials), and electrolysis of rare earth oxide (raw material) dissolved in an electrolyte bath of fused fluorides. The former technique suffers a problem of a difficult handling of the fused chlorides, and a further problem resulting from the batch style which is not suitable for a continuous operation in a large scale. On the other hand, the latter technique has a problem of a low solubility of the oxide in the electrolyte bath, which hinders a continuous electrolysis operation and results in an accumulation of sludge on the bottom of the electrowinning cell. It is recommended for a continuous and large scale production that the rare earth of its alloy is produced in a liquid state, but it is impractical to raise to an excessively high electrolysis temperatures at which the electrolysis operation is conducted, according to a high melting point of the rare earth to be obtained, since at higher temperatures non-metallic inclusions more easilly enter into the rare earth or its alloy produced.

On the other hand, the reduction method utilizing an active metal belongs to a batch system and is therefore not suitable for a continuous and large scale production. Further, this method has a disadvantage of use of an expensive active metal (reducing agent) and use of expensive materials for the exclusive apparatus. This method has another disadvantage of involving an additional step for removing the residual active agent.

(B) Another method wherein alloying is executed by means of reducing a mixture of a rare earth compound and a compound of metal to be alloyed with the rare earth by utilizing a reducing agent (e.g., calcium hydride for a Sm-Co alloy):

This method needs an expensive reducing agent, and can not be, either, an exception of the batch-style method, being unsuitable for a continuous and large scale operation.

(C) Still another method wherein an alloy of rare earth and a metal to be alloyed with the rare earth is electrodeposited on the cathode by electrolytic reduction which is carried out in a bath of electrolyte dissolving both a compound of the rare earth and a compound of the metal to be alloyed with the rare earth (a U.S. Pat. No. 3,298,935 can be referred), therein:

This method is problematical in that it is difficult to keep the chemical composition of the alloy produced on the cathode, uniform over a long period of time during the electrolysis operation. Further, in the case where oxide is used as a raw material, the method has a problem of a low solubility of the oxide in the electrolyte bath, which hinders a continuous electrolysis operation.

(D) So-called consumable cathode method, wherein rare earth is electrodeposited by electrolytic reduction on a consumable cathode of a metal and alloyed with the metal of the cathode, in one step which is executed in a suitable bath of electrolyte of fused salts (can be referred "U.S. Bur. of Min., Rep. of Invest.", No. 7146, 1968, and Japanese Pat. Nos. 837401 and 967389):

The shortcomings will be described below: in the case where a rare earth oxide is used as a raw material to be reduced, the method suffers problems, as stated previously, of a low solubility of the rare earth oxide in the selected electrolyte bath and of an accumulated sludge of the oxide; moreover, conducting the electrolysis operation at increased temperatures for overcoming those problems results in producing a deteriorated alloy containing an increased amount of non-metallic inclusions as coming from the structural materials of the electrowinning cell. Further, the recovery of the produced alloy is carried out in a batch style which is unsuitable for a continuous and large-scaled operation.

Some of the present inventors and others have file a U.S. patent application (Ser. No. 776,800, Sep. 17, 1985) in which a process of producing neodymium-iron alloy and an apparatus therefor are described and claimed, but no disclosure is found about a process of producing dysprocium-iron alloy or neodymium-dysprosium-iron alloy nor an apparatus therefor.

Metallic dysprosium has been, in fact, almost useless, and the industrial manufacturing process of getting the same has not been settled, yet, except for the above-mentioned reduction method (A) in which dysprosium can be produced in a small quantity. It can be said that no industrially practical process is firmly established for continuously producing dysprosium. It is a matter of fact that there has been not established an industrial method of continuously producing a dysprosium-iron alloy for use as an alloying material for a high-quality permanent magnet made of neodymium, dysprosium, iron and boron. Similarly, there has been no established method of continuously producing a neodymium-dysprosium-iron alloy for the same use.

SUMMARY OF THE INVENTION

This invention was made in the above-mentioned background. An object of this invention is, therefore, to provide a process and an apparatus for producing a dysprosium-iron alloy or neodymium-dysprosium-iron alloy which are suitable for a continuous and large-scale production, and in particular a reliable, economical industrial process and apparatus for producing a dysprosium-iron alloy or neodymium-dysprosium-iron alloy with high content of dysprosium or high content of neodymium and dysprosium, and with low contents of impurities and non-metallic inclusions.

According to a first aspect of this invention, there is provided a process of producing a dysprosium-iron alloy or neodymium-dyprosium-iron alloy, including the steps of: (a) preparing a bath of molten electrolyte which has a composition consisting essentially of 20–95% by weight of dysprosium fluoride or a mixture of neodymium fluoride and dysprosium fluoride, 5–80% by weight of lithium fluoride, up to 40% by weight of barium fluoride and up to 20% by weight of calcium fluoride; (b) effecting electrolytic reduction of the dysprosium fluoride or the neodymium fluoride and dysprosium fluoride in the bath of molten electrolyte, with at least one iron cathode and at least one carbon anode, so as to electrodeposit dysprosium or neodymium and dysprosium on the at least one iron cathode, and alloying the electrodeposited dysprosium or neodymium and syprosium with iron of the at least one iron cathode so as to produce the dysprosium-iron alloy or neodymium-dysprosium-iron alloy in a liquid state on the at least one iron cathode; (c) adding the dysprosium fluoride or mixture of neodymium fluoride and dysprosium fluoride to the bath of molten electrolyte so as to maintain the composition of the bath of molten electrolyte, for compensating for consumption of the dysprosium fluoride or the neodymium fluoride and dysprosium fluoride during production of the dysprosium-iron alloy or neodymium-dysprosium-iron alloy; (d) dripping the liquid dysprosium-iron alloy or neodymium-dysprosium-iron alloy from the at least one iron cathode into a receiver having a mouth which is open upward in a lower portion of the bath of molten electrolyte below the at least one iron cathode, and thereby collecting the liquid dysprosium-iron alloy of neodymium-dysprosium-iron alloy in the form of a molten pool in the receiver; and (e) withdrawing the molten pool of the liquid dysprosium-iron alloy or neodymium-dysprosium-iron alloy from the receiver.

In the above-mentioned method according to the present invention, a dysprosium-iron alloy or neodymium-dysprosium-iron alloy can be manufactured in only one step of electrolytic reduction. And in this one step of electrolytic reduction, a dysprosium-iron neodymium-dyprosium-iron alloy of high content of dysprosium or neodymium and dysprosium and of low content of impurities and non-metallic inclusions that adversely affect its materials properties, i.e., its performance or quality for use as a material for permanent magnets or magnetooptical disks, can be manufactured in an economical, continuous and large-scale operation. The invented method is additionally provided with various advantages; use of a solid cathode allows easy handling of the same; siphoning the produced alloy in a liquid state in the course of the electrolysis or electrowinning makes it possible to continue the electrolysis substantially without interruption, i.e., a continuous operation of the electrolysis is attainable; the advantage of the use of so-called consumable cathode is fully attainable, i.e., a continuous operation of the electrolysis under lower temperatures remarkably improves the electrolysis results or yields and the grades of the produced alloys.

This method according to the present invention allows to enlarge the scale of the operation and to elongate the time duration of the operation which has been regarded impossible in the reduction processes using an active metal such as calcium, and also allows to effectively restrict the entering of impurities such as the active metal into the produced alloy. It further allows to fundamentally eliminate difficulties observed in the continuous operation of the electrolytic manufacturing method executed in a mixture of fused salts of fluoride and oxide(s) which uses dysprosium oxide or a mixture of neodymium oxide and dysprosium oxide as raw materials.

The method of the invention allows to carry out the electrolysis operation at lower temperatures than the method using dysprosium oxide or neodymium oxide and dysprosium oxide as the raw materials. Operation at lowered temperatures is advantageous in that is effectively restricted the entering of impurities and non-metallic inclusions as coming from the structural materials of the electrowinning cell. Another advantage of this method resides in the capability of using a higher anode current density than the method using the dysprosium oxide or the mixture of neodymium oxide and dysprosium oxide, at the same temperature. That is, in the case where the present method and the method using the oxide or oxides employ an anode with the same dimensions, the present method is permitted to use a higher current density, thereby assuring a better productivity.

In the above-mentioned method, can be manufactured a neodymium-dysprosium-iron alloy which has the chemical composition with a constant ratio of neodymium to dysprosium. The produced alloy is advantageously used as an alloying material for, for example, permanent magnets, since the manufacturing cost of the magnets are decreased by use of the produced alloy, that is, by simultaneous introduction of neodymium and dysprosium into the magnets.

In a preferred embodiment of the process according to the invention, the bath of molten electrolyte consisting essentially of 20–95% by weight of dysprosium fluoride, 5–80% by weight of lithium fluoride, up to 40% by weight of barium fluoride and up to 20% by weight of calcium fluoride, is held at temperatures within a range of 870°–1000° C., and the electrolytic reduction is effected at these temperatures. In the case where is used the bath of molten electrolyte consisting essentially of 20–95% by weight of neodymium fluoride and dysprosium fluoride, 5–80% by weight of lithium fluoride, up to 40% by weight of barium fluoride and up to 20% by weight of calcium fluoride, the bath is held at temperatures within a range of 800°–1010° C., and the electrolytic reduction is effected at these temperatures.

In another embodiment of the above-indicated process, the electrolytic reduction is effected by applying a direct current to the at least one carbon anode with a current density of 0.05–4.0 A/cm$^2$, and to the at least one iron cathode with a current density of 0.50–80 A/cm$^2$.

In still another embodiment of the above-indicated process, the at least one carbon anode is made of graphite.

In a further embodiment of the above-indicated process, the at least one iron cathode is an elongate solid member having a substantially constant transverse cross sectional shape over its length.

In a still further embodiment of the above-indicated process, the at least one iron cathode is an elongate tubular member having a substantially constant transverse cross sectional shape over its length.

In a yet further embodiment of the above-indicated process, the bath of molten electrolyte consists essentially of at least 25% by weight of the dysprosium fluoride or the mixture of neodymium fluoride and dysprosium fluoride, and at least 15% by weight of lithium fluoride.

According to a second aspect of the present invention, there is provided an apparatus for producing a dysprosium-iron alloy or neodymium-dysprosium-iron alloy by electrolytic reduction, including: (A) an electrowinning cell formed of refractory materials for accommodating a bath of electrolyte consisting essentially of dysprosium fluoride or a mixture of neodymium fluoride and dysprosium fluoride, and lithium fluoride, and optionally barium fluoride and calcium fluoride as needed; (B) a lining applied to the inner surface of the electrowinning cell and contacting the bath of electrolyte; (C) at least one elongate carbon anode having a substantially constant transverse cross sectional shape over its length, and projecting into the electrowinning cell such that a lower free end portion of the at least one carbon anode is immersed in the bath of electrolyte; (D) at least one elongate iron cathode having a substantially constant transverse cross sectional shape over its length, and projecting into said electrowinning cell such that a lower free end portion of said at least one iron cathode is immersed in said bath of electrolyte; (E) a receiver having a mouth which is open upward in a lower portion of the electrowinning cell below the free end portion of the at least one iron cathode, the receiver collecting a molten pool of a dysprosium-iron alloy or neodymium-dysprosium-iron alloy which is produced on the at least one iron cathode by means of electrolytic reduction of the dysprosium fluoride or the mixture of neodymium fluoride and dysprosium fluoride with a direct current applied between the at least one carbon anode and the at least one iron cathode, the produced dysprosium-iron alloy or neodymium-dysprosium-iron alloy being dripped off the at least one iron cathode into said receiver; (F) siphoning means for withdrawing said molten pool of the dysprosium-iron alloy or neodymium-dysprosium-iron alloy from the receiver out of the electrowinning cell; and (G) feeding means for feding the at least one iron cathode into the bath of electrolyte so as to apply the direct current to the at least one iron cathode with a predetermined current density, for compensating for consumption of the at least one iron cathode during production of the dysprosium-iron alloy or neodymium-dysprosium-iron alloy.

In a preferred embodiment of the apparatus according to the second aspect of the invention, the at least one iron cathode is an elongate solid member.

In another embodiment of the above-described apparatus, the at least one iron cathode is an elongate tubular member. The tubular iron cathode may be connected to a protection gas supplying means from which a protection gas is blown into the bath of electrolyte through an opening at a lower end of the at least one iron cathode.

In a further embodiment of the above-described apparatus, the apparatus further including raw material-supply means for adding the dysprosium fluoride or the mixture of neodymium fluoride and dysprosium fluoride to the bath of electrolyte. In this case, the at least one iron cathode may be an elongate tubular member through which the dysprosium fluoride or the mixture of neodymium fluoride and dysprosium fluoride is supplied into the bath of electrolyte, and which thus serves as part of the raw material-supply means.

In a yet further embodiment of the above-described apparatus, the apparatus further including ascent-and-descent means for positioning the at least one carbon anode into the bath of electrolyte so as to apply the direct current to the at least one carbon anode with a predetermined current density, for compensating for consumption of the at least one carbon anode during production of the dysprosium-iron alloy or neodymium-dysprosium-iron alloy.

In another embodiment of the above-described apparatus, the siphoning means includes a siphon pipe which is disposed so that one end thereof is immersed in the molten pool of the dysprosium-iron alloy or nodymium-dysprosium-iron alloy in the receiver, the siphoning means further including suction emans for sucking the liquid dysprosium-iron alloy or neodymium-dysprosium-iron alloy under vacuum from the receiver out of the electrowinning cell.

In yet another embodiment of the above-described apparatus, the lining is made of a ferrous material.

In a further embodiment of the above-described apparatus, the at least one carbon anode is made of graphite.

BRIEF DESCRIPTION OF THE DRAWINGS

These and other objects, and many of the attendant features and advantages of this invention will be readily appreciated, as the same becomes better understood by reference to the following detailed description of illustrative embodiments when considered in connection with the accompanying drawings, in which.

DETAILED DESCRIPTION OF THE PREFERRED EMBODIMENTS

To further clarify the present invention, illustrative embodiments of the invention will be described in detail with reference to the accompanying drawings. One embodiment relates to a process of producing a dysprosium-iron alloy and an apparatus therefor, while another embodiment relates to a process of producing a neodymium-dysprosium-iron alloy and an apparatus therefor.

Figure 1:
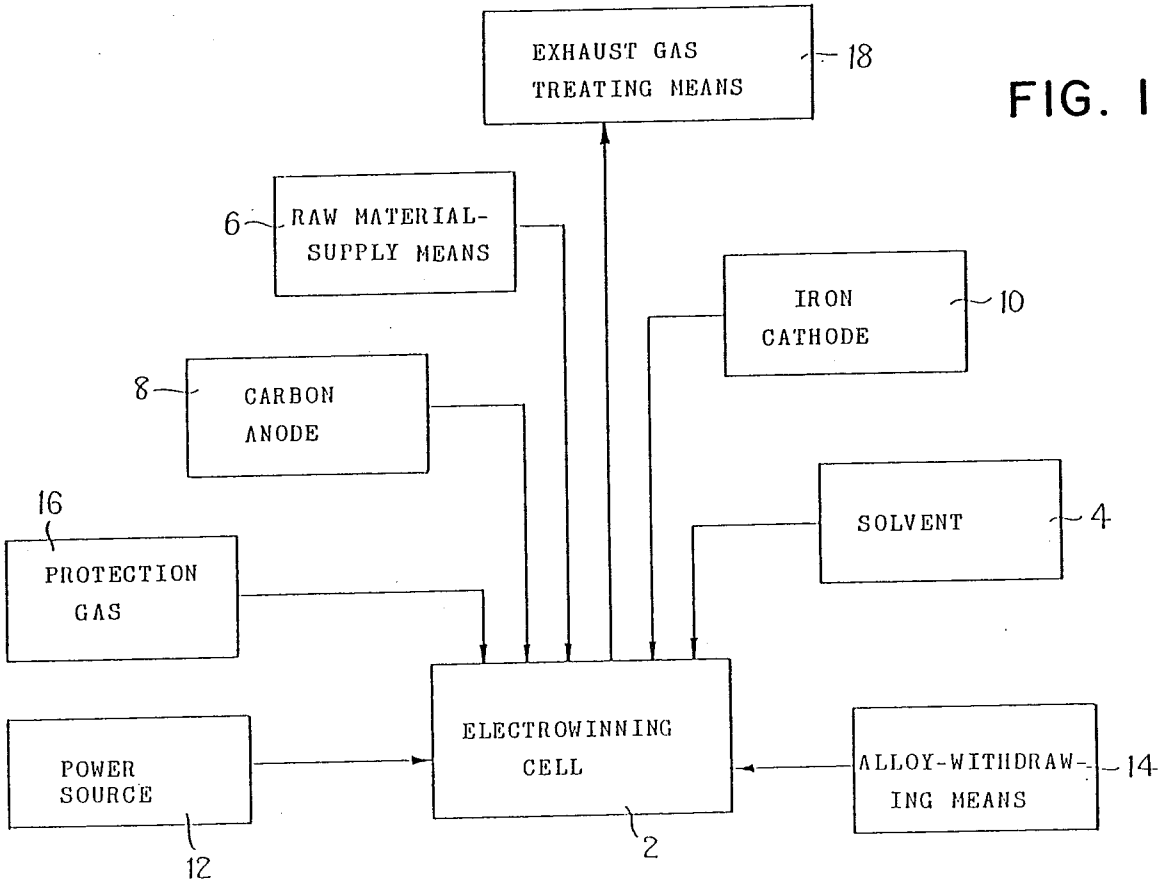
FIG. 1 is a schematic diagram of a preferred embodiment of the electrolysis system for practicing the method according to this invention.

An electrowinning cell 2, which is a principal part of the electrolysis or electrowinning system illustrated in the schematic diagram of FIG. 1, is to contain in it a solvent 4 constituting an electrolyte bath or mixed molten salts. As the solvent 4, a mixture of dysprosium fluoride ($DyF_3$) and lithium fluoride (LiF) is used for the former embodiment, while a mixture of neodymium fluoride ($NdF_3$), dysprosium fluoride, lithium fluoride is used for the latter embodiment; For either of the two embodiments, it is possible, however, to optionally add barium fluoride ($BaF_2$) and calcium fluoride ($CaF_2$), individually or simultaneously as needed. The electrolysis raw material is supplied, on the other hand, from a raw material-supply means 6 into the electrolyte bath in the electrowinning cell 2. As the raw material, dysprosium fluoride is used for the former embodiment, in place of the traditional raw material, dysprosium oxide ($Dy_2O_3$), and the dysprosium fluoride is at the same time one component of the electrolyte bath. For the latter embodiment, a mixture of neodymium fluoride and dysprosium fluoride is used, in place of neodymium oxide ($Nd_2O_3$) and dysprosium oxide ($Dy_2O_3$), as the raw materials. The neodymium fluoride and dysprosium fluoride are at the same time components of the electrolyte bath.

In the electrolyte bath contained in the electrowinning cell 2, a carbon anode or anodes 8 and an iron cathode or cathodes 10 are respectively inserted to be immersed therein. Between the anodes 8 and the cathodes 10 direct current is applied with a power source 12 so as to carry out electrolytic reduction of the raw material(s), dysprosium fluoride or neodymium fluoride and dysprosium fluoride. Metallic dysprosium or metallic neodymium and dysprosium electrodeposited on the cathodes 10 will immediately produce an alloy, in a liquid state, together with the iron constituting the cathodes 10. The liquid alloy produced on the cathodes 10 will drip one after another into a receiver placed in the electrolyte bath in the electrowinning cell 2 and will make a molten pool therein. Since the produced alloy on the cathodes 10 becomes liquid at the temperature where the electrolyte is fused, and specific gravity of the electrolyte bath is chosen smaller than that of the produced alloy, the liquid alloy drips readily one after another off the surface of each cathode 10 as it is formed there.

The liquid alloy, collected in this manner in the receiver which is located below the cathodes 10 and the mouth of which is open upward, is withdrawn from the electrowinning cell 2 with a suitable siphoning means, i.e., alloy-withdrawing means 14 so as to be recovered.

In the latter embodiment for producing a neodymium-dysprosium-iron alloy, the mixture of neodymium fluoride and dysprosium fluoride are used as the electrolysis raw materials, instead of the neodimium oxide and dysprosium oxide. The studies conducted by the inventors et al. have revealed that, even in the case where the mixture of neodymium fluoride and dysprosium fluoride are used as the raw materials, the neodymium-dysprosium-iron alloy produced on the iron cathode has a chemical composition with almost the same ratio of neodymium (weight) to dysprosium (weight) as that of the electrolyte bath. Therefore, a desired neodymium-dysprosium-iron alloy whose composition has a desired ratio of neodymium to dysprosium, can be continuously obtained by supplying the mixture of neodymium fluoride and dysprosium fluoride having the same ratio, to the electrolyte bath having the same ratio, in course of electrolysis operation. This advantage of the present method has been found to be held over an entire range of the ratio of neodymium to dysprosium of the mixture of neodymium fluoride and dysprosium fluoride.

Further, protection gas 16 is introduced into the electrowinning cell 2 for the purpose of preventing the electrolyte bath, the produced alloy, the anodes 8 and the cathodes 10, and the structural materials of the cell from being deteriorated, and also of avoiding the picking of harmful impurities and non-metallic inclusions in the produced alloy. A gas or gases produced in the electrowinning cell 2 in the course of the electrolytic reduction are introduced into an exhaust gas-treating means 18 together with the protection gas 16 for being placed under a predetermined treatment.

In the electrolysis system of the present invention, dysprosium fluoride or a mixture of neodymium fluoride and dysprosium fluoride is used as the electrolysis raw material(s) instead of dysprosium oxide or neodymium oxide and dysprosium oxide. Since the dysprosium fluoride or the mixture of the fluorides, being the raw material(s), is in this system a principal component of the electrolyte bath at the same time, supplementing the same in the bath as it is consumed in the course of electrolysis is relatively easy. Another merit of use of the fluoride or fluorides, used as the raw material(s), resides in that it allows continuation of the electrolysis in far wider a range of raw material concentration in the bath as compared with in the oxide electrolysis. As to the way of supplementing the raw material(s), sprinkling powder of dysprosium fluoride or mixture of neodymium fluoride and dysprosium fluoride over the surface of the electrolyte bath in quite common and preferable because of its easier dissolution into the bath. It is, however, allowable to introduce it into the bath together with a gas, or to immerse a compressed powder briquette. Another advantage of the use of the fluoride or fluorides superior to the oxide or oxides as the raw material(s) is far wider a range of allowance in the electrolytic raw material concentration observed within the interpolar electrolysis region in the bath. Continuation of the electrolytic operation, being provided with a wider allowance range in the raw material concentration in the bath, is not affected so much by a delay of raw material feed to this interpolar region. In comparision with the traditional operation using the dysprosium oxide or the mixture of neodymium oxide and dysprosium oxide, the invented method using the fluoride or fluorides, with far wider a region of allowance in regards to its concentration, is relieved to a large extent from restrictions on the raw material supply position and on the raw material supply rate depending upon the current applied.

In the manufacturing of the dysprosium-iron alloy or neodymium-dysprosium-iron alloy, according to the invention, of low content of impurities and non-metallic inclusions, it is required to maintain the electrolysis temperature as low as practicable. For this purpose, a mixture of molten salts consisting substantially of 20–95% by weight of dysprosium fluoride or a mixture of neodymium fluoride and dysprosium fluoride, 5–80% by weight of lithium fluoride, 0–40% by weight of barium fluoride and 0–20% by weight of calcium fluoride (total of the dysprosium fluoride or mixture of two fluorides, the lithium fluoride, the barium fluoride and the calcium fluoride amounts to substantially 100%) is selected as the electrolyte bath. Even when the raw material(s) of dysprosium fluoride or mixture of neodymium fluoride and dysprosium fluoride is added to the electrolyte bath, the bath must be adjusted so as to maintain during the entire process of electrolysis the above-mentioned composition.

In regard to the composition of the components of the electrolyte bath, lowering of the dysprosium fluoride concentration or of the neodymium fluoride an dysprosium fluoride concentration below the lowest limit, i.e., less than 20% will deteriorate the electrolysis results, and raising beyond the highest limit, i.e., higher than 95% will problematically increase the melting point of the bath. As to the concentration of lithium fluoride, excessive lowering thereof will raise the melting point of the bath, and excessive raising thereof will make the mutual interaction between the produced alloy and the bath too vigorous, causing thereby deterioration of the electrolysis results. The concentration of the lithium fluoride must be therefore adjusted in the range of 5–80%.

Adding the barium fluoride and/or the calcium fluoride is aimed at decreasing the amount of use of the expensive lithium fluoride and also aimed at the adjustment of the melting point of the mixed electrolyte bath. Excessive addition of them tends to raise the melting point of the bath, so the concentration of the former must be limited up to 40% and that of the latter to 20%, although they may be used either singly or parallelly. In any way the electrolyte bath must always be so composed of as to make the sum of the four components, i.e., dysprosium fluoride, lithium fluoride, barium fluoride and calcium fluoride, or the five components, i.e., neodymium fluoride plus the above four components, to be substantially 100%. It is preferable again, when the electrolyte bath is composed only of dysprosium fluoride or the mixture of neodymium fluoride and dysprosium fluoride, and lithium fluoride, to adjust the concentration of the former to more than 25% and that of the latter more than 15%.

Each of the four or five components of the electrolyte bath need not necessarily be of high purity, unless they contain such impurities as to affect the electrolysis and the quality of the final products, such as magnetic properties of the permanent magnet. Presence of impurities, inevitably included in the ordinary industrial materials, are tolerable in the electrolyte bath, so far as the impurities are allowable to the final uses. The composition of the electrolyte bath must be selected, so that the specific gravity of the bath may be smaller than that of the produced dysprosium-iron alloy or neodymium-dysprosium-iron alloy. The alloy produced on the cathode can drip off the cathode into the alloy receiver with an opening, located below the cathode because of this difference of the specific gravity between the two.

In the (former) embodiment for producing a dysprosium-iron alloy, the temperature of the electrolyte bath is preferably adjusted during electrolysis between 870° and 1000° C. At an excessively high temperature, impurities and foreign matters can enter into the products beyond the allowable limit. On the other hand, at an excessively low temperature, the dysprosium produced on the cathode is not fully fused with the iron of the cathode, since the eutectic temperature of the dysprosium-iron alloy is about 845° C. In this case, metal dysprosium with a relatively high melting point (1409° C.) is electrodeposited in a solid state on the cathode. The solid dysprosium produced on the cathode often causes interpolar short-circuiting, and finally hinders continuation of the electrolysis operation. It goes without saying that at the lowest possible temperature within the above-mentioned range can be manufactured the purest possible dysprosium-iron alloy that has the least possible impurities and non-metallic inclusions as coming from the structural materials of the electrowinning cell.

In the (latter) embodiment for producing a neodymium-dysprosium-iron alloy, the temperature of the electrolyte bath is preferably adjusted during the electrolysis operation between 800° and 1010° C. At an excessively high temperature, impurities and foreign matters can enter into the products beyond the allowable limit. On the other hand, at an excessively low temperature, it is difficult to keep the bath composition uniform, with a result of deteriorating the nature of the bath so as to finally hinder continuation of the electrolysis. As in the former embodiment, at the lowest possible temperature within the above-mentioned range is manufactured the purest possible neodymium-dysposium-iron alloy that has the least possible impurities and non-metallic inclusions as coming from the structural materials of the electrowinning cell.

Within the above-mentioned temperature limits, a dysprosium-iron alloy or neodymium-dysprosium-iron alloy of high content, more than 80% by weight, or dysprosium or of neodymium and dysprosium can be manufactured, and the produced alloy forms liquid metal in the receiver. This molten alloy can be effectively siphoned or withdrawn from the electrowinning cell by vacuum suction. It is also possible to tap is from the bottom of the cell by flowing-down by gravity. In either way of the withdrawing of the alloy, it needs not to be heated at all, because it can be withdrawn easily in the liquid state as it is.

As to the electrodes used in the electrolysis in this invention, it is preferable to use iron for the cathode and use carbon, in particular, graphite for the anode. Iron for the cathode must be of low content of impurities because such impurities are easily introduced into the dysprosium-iron alloy or neodymium-dysprosium-iron alloy manufactured. In both embodiments, the iron cathode is consumed during the electrolysis operation so as to form the alloy. Compensation for the consumption of the cathode by means of gradual immersion of the same into the electroyte bath will, however, enable to continue, without interruption, the electrolysis, i.e., manufacturing of the alloy. In this case the iron material as the cathode may be connected one after another by forming the threading on both ends, which makes it easy to continuously compensate for the consumption of the cathode. Use of such a solid iron cathode is, in comparison with a molten metal cathode, far more convenient in the handling thereof and is advantageous for simplifying the structure of the electrowinning cell. It naturally allows enlarging of the electrowinning cell, to a great advantage, in a case of industrialization.

In the electrolysis of the dysprosium fluoride or the mixture of neodymium fluoride and dysprosium fluoride using carbon anodes in this invention, it is desirable to maintain the current density over the whole immersion surface of the anodes within the range of 0.05–4.0 $A/cm^2$ during all the time of the electrolysis operation. When the current density is excessively small, it means either that the immersion surface of the anode is too large or that the current per unit area of the anode surface is too small, which deteriorates the productivity, with a result of industrial demerit. On the other hand, raising the current density to too high a level tends to bring about the anode effect which has been observed in the electrolysis using the dysprosium oxide or the mixture of neodymium oxide and dysprosium oxide as its raw material, or some other similar abnormal phenomena. It is therefore recommendable in the invention to maintain the anode current density within the above-mentioned range, as one of the required conditions for the electrolysis, so as to effectively prevent occurrence of such abnormal phenomena. In the former embodiment it is particularly more preferable to keep the current density between 0.30 $A/cm^2$ and 3.0 $A/cm^2$ over the whole immersion surface of the anodes, from the consideration of possible variation of the current density on a local area thereof. On the other hand, in the latter embodiment it is more preferable to keep the current density between 0.1 $A/cm^2$ and 3.0 $A/cm^2$ over the whole immersion surface of the anodes, from the same consideration. At the same temperature, the dysprosium fluoride or the mixture of neodymium fluoride and dysprosium fluoride, used as the raw material(s) for the electrolysis, permits the anode to have a higher current density than the dysprosium oxide or the mixture of neodymium oxide and dysprosium oxide does. This is advantageous in view of industrial production.

As to the current density on the cathode in this invention a fairly broad range such as 0.50–80 $A/cm^2$ is allowed over the whole immersion surface thereof. When the current density on the cathode is too low, however, the current per unit surface area of the cathode becomes too small, deteriorating the productivity to the extent of being industrially impractical; when it excessively rises, on the contrary, electrolytic voltage rises to such as to deteriorate the electrolysis results. In the actual electrolysis operation in the production line it is preferable, for body embodiments, to keep the cathode current density in a narrower range, 1.0–30 $A/cm^2$, which facilitates keeping the voltage fluctuation small and makes the electrolysis operation easy and smooth.

Regarding the electrodes, the anode is in this invention provided as a carbon anode independently, not letting the bath container or crucible, which is made of a material resistant to the corrosive action of the bath, function simultaneously as the anode, so consumption of the anode does not necessarily require stoppage or interruption of the operation as in the case of the crucible anode. A separately provided anode may be compensated for the consumption thereof by immersing the same deeper into the bath at it shortens. When the anode is provided in plurality, they can be replaced one by one as they shorten. As to the cathode, consumption can be compensated similarly in both embodiments only by the deeper immersion of the same or by the replacement thereof. As to the arrangement or configuration of both electrodes, it is preferable in this invention, to set a plurality of anodes around each cathode so that the former can face the latter, taking advantage of the fairly large difference of the current density between the anode and the cathode. In that case replacement of the anodes is an easy task, allowing their successive replacement and thereby never interrupting alloy-producing operation. The benefits of the electrolysis process can be herewith fully realized. It is also practically very convenient that both the anodes and cathodes have their constant and uniform shapes in their longitudinal direction, which facilitates their continuous and successive use, by being replaced in turn.

An electrowinning cell of these embodiments will be described in detail with reference to a preferable form illustrated in FIG. 2 as a schematical section view.

The cell which is allotted the reference numeral 20 is composed of a lower main cell 22 and a lid body 24 covering the opening of the former. Outer side of these two members 22 and 24 are covered by metallic outer shells 26, 28, respectively. Usually, the outer shells 26, 28 are made of steel or the like. Both the lower main cell 22 and the lid body 24 are respectively provided, inside the outer shells 26, 28, with double lining layers laid one on the other, the outer being a refractory heat-insulating layer 30, 32 made of brick or castable alumina, etc., and the inner being a layer 34, 36 which is resistant to the bath and is made of graphite, carbonaceous stamping mass, or the like.

The inner side of the corrosion-resistant material layer 34 is further provided with a lining member 38 for covering the potentially bath-contacting surface thereof. The lining member 38 functions to prevent entering of trace of impurities coming from the corrosion-resistant layer 34, and when it is made of a refractory metal such as tungsten, molybdenum, etc., it can work at the same time as the earlier mentioned receiver for the dipping alloy. However, it is recommended in this invention to use an inexpensive iron material for the lining member 38. Studies of the inventors et al. came to a discovery that the inexpensive iron has unexpected excellent corrosion resistance to the action of the electrolyte bath, i.e., fused fluoride salts and that it can be a suitable lining member in the case of electrolyte bath of fluorides. It is permissible to omit the layer 34, since the lining member 38 can be directly applied on the refractory heat-insulating layer 30.

Passing through the lid body 24, one or plural iron cathodes 40 and a plurality of carbon anodes 42, arranged to face each cathode 40, are set such that both 40, 42 may be immersed into the electrolyte bath of predetermined molten salts contained in the lower main cell 22 by the length or distance appropriate to produce a predetermined current density on each of the electrodes. The only two carbon anodes 42, 42, which should be arranged to face the iron cathode 40, are illustrated in the drawing. As the material for the anodes, graphite is recommendable.

Those carbon anodes 42 may be used in a variety of shapes, such as a rod form, a plate form, a pipe form, etc. They may also be fluted, as be well known, with the object of lowering the anode current density by enlarging the anode surface area of the immersed portion thereof in an electrolyte bath 44. The carbon anodes 42 in FIG. 2 are slightly tapered on the immersed portion thereof in order to show trace of the anode consumption. Those anodes 42 may be provided with a suitable electric lead-bar of metal or a like conductive material for the purpose of power-supplying. They are also equipped with an ascent-and-descent device 46, with which they can be moved up and down into the bath and also adjusted continuously or intermittently as to the length of the immersed portion thereof so as to surely maintain the required anode current density. In other words, the surface area of the immersed portion, on which the anode current density under a continuous and constant current depends, is adjusted through the length thereof. The ascent-and-descent device 46 may be imparted the function, at the same time, as an electric contact.

The cathode or cathodes 40 are, on the other hand, made of iron, which is to be alloyed with the metallic dysprosium or the metallic neodymium and dysprosium in the electrolyte bath through the electrolytic reduction. In FIG. 2 only one cathode 40 is illustrated, and its immersed portion is shown in a cone, which means a sign of the cathode consumption due to dripping of the produced alloy of dysprosium-iron or neodymium-dysprosium-iron. The cathode 40 takes a solid form, as the electrolysis temperature is selected below the melting point of the iron cathode 40, and may be a wire, a rod, or a plate in its shape. This cathode 40 is also equipped with an ascent-and-descent device 48, with which it is introduced into the bath 44 continuously or intermittently so as to compensate for consumption thereof due to the alloy formation. The asecent-and-descent device 48 can simultaneously work as an electric contact. It is permissible to protect the non-immersed portion thereof with a sleeve or the like from corrosion.

For the purpose of receiving the alloy thus produced on the tip of the cathode 40, a receiver 50 is placed, in the bath 44, on the bottom of the lower main cell 22, with an opening or mouth thereof just below the cathode 40. A drop-formed liquid dysprosium-iron alloy or neodymium-dysprosium-iron ally 52, produced on the tip of the cathode 40 by the electrolytic reduction, drips off the cathode 40 and falls down to be collected in the receiver 50. This receiver 50 may be made of a refractory metal such as tungsten, tantalum, molybdenum, niobium, or their alloy, with small reactivity to the produced alloy 52. As its material, ceramics made of borides like boron nitride or of oxides or cermet is also permissible.

The electrolyte bath 44 is a fused salt solution of a fluoride mixture containing the dysprosium fluoride or the neodymium fluoride and dysprosium fluoride therein with an adjusted composition according to this invention, and its composition is so selected as to make the specific gravity thereof to be smaller than that of the produced dysprosium-iron alloy or neodymium-dysprosium-iron alloy. The electrolysis raw material which is consumed through electrolytic operation is supplemented by feeding it from a raw material-supply means 56 formed in the lide body 24 so as to prepare and maintain the electrolyte bath 44 of a predetermined preferable composition.

As mentioned earlier the produced alloy 52, which drips off the iron cathode 40 to be reserved in the receiver 50, is, when the reserved amount reaches to a certain predetermined value, withdrawn in a liquid state from the electrowinning cell 20 by a predetermined alloy siphoning or tapping system. In the present invention, an alloy-siphoning system such as illustrated in FIG. 2 is preferably used for this purpose, wherein a pipe-like vacuum suction nozzle 58 is inserted, through a produced alloy suction hole 60 formed in the lid body 24, into the electrolyte bath 44, such that the lower end of the nozzle 58 can be immersed into the produced alloy 52 in the alloy receiver 50, and the alloy 52 is withdrawn, through sucking action of a vacuum means (not illustrated), from the electrowinning cell 20.

It is also permissible here to install an alloy tapping or flowing-out system, in place of the alloy siphoning system for withdrawing the alloy 52 by evacuation, which is provided with a tapping pipe, passing through the wall of the electrowinnning cell 20 (lower main cell 22) and further passing through the wall of the alloy receiver 50, for having its opening in the alloy receiver 50, so as to flow the alloy 52 down out of the lower main cell 22 by gravity.

There is a not illustrated protection gas-supplying device, in this invention for supplying protection gas into the cell 20 such that possibly generated gas or gases in the course of electrolysis operation may be discharged together with the protection gas through an exhaust gas outlet port 62. It goes without saying that a heating device may be equipped with, when needed, inside or outside the cell 20 for maintaining the electrolysis temperature to a desired level, although it is not shown in the figure.

There will be described some examples of this invention, which, however, are shown for illustrative purpose only. Examples 1 and 2 relate to the (former) embodiment for producing a dysprosium-iron alloy, and Examples 3 through 6 relate to the (latter) embodiment for producing a neodymium-dysprosium-iron alloy.

The present invention can be practiced in variety of ways other than the above-mentioned description and the disclosed embodiments as well as the following examples, based on the knowledge of those skilled in the art, within the limit and spirit thereof. All of those varieites and modifications should be understood to be included in this invention.

EXAMPLE 1

A rare earth-iron alloy (RE-Fe), 2.11 kg, with an average composition of 92% by weight of rare earth metals including dysprosium for the most part and 8% by weight of iron was obtained by the following process.

Figure 2:
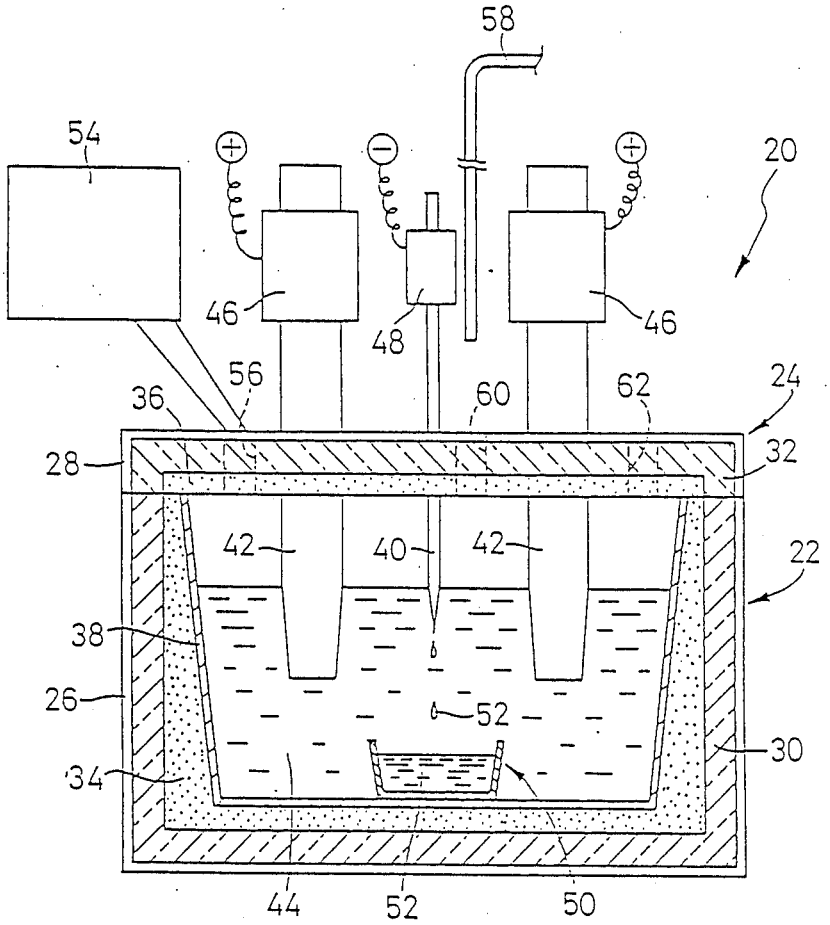
FIG. 2 is a sectional view for illustrating a structure of an example of the electrowinning cell, with which the present invention is practiced.

An electrolyte bath consisting substantially of two fluorides, i.e., dysprosium fluoride and lithium fluoride was electrolyzed, at an average temperature 896° C., in an inert gas atmosphere with an electrowinning cell of the type shown in FIG. 2. As the cell, was used a graphite crucible which is lined by a lining member made of a ferrous material resistive to the bath. An alloy receiver made of molybdenum was placed in the middle portion of the bottom of the graphite crucible. A single wire-like vertical iron cathode with 6 mm$\phi$ was immersed in the bath in the middle portion of the graphite crucible, while four of rod-like vertical grapite anodes with 40 mm$\phi$ were immersed in the bath in a concentrical (in the plane view) arrangement around the single cathode.

Powdered dysprosium fluoride as the raw material was continuously supplied so as to maintain the electrolysis operation for 16 hours under the operation conditions shown in Table I. All the time during this operation, the electrolysis was satisfactorily continued, wherein produced liquid rare earth(dysprosium)-iron alloy dripped one by one to be collected in the molybdenum redeiver placed in the bath. The alloy was siphoned from the cell once every eight hours with a vacuum suction type alloy siphoning system having a nozzle.

The electrolysis results and the analysis results of the obtained alloy are shown in Table I and Table II, respectively. Values of current efficiency (%) in Table I were determined based upon the weight of rare earth metals obtained, on the assumption that the rare earth metals include dysprosium only.

For the purpose of comparison, another electrolysis was executed, at an average temperature 935° C., in a similar cell and under substantially similar conditions, where powdered dysprosium oxide as the raw material was continuously supplied to an electrolysis area between the cathode and the anodes where anode gases were evolved. In the experiment, anode effect took place often so as to stop a further electrolysis of the oxide. Trials for preventing the occurence of the anode effect by lowering the anode current density had been unsatisfactory until the anode current density was lowered below half of the anode current density for the case where the fluorides only were used as the raw materials. Supplying an increased amount of the oxide to prevent the anode effect resulted in an increased amount of sludge on the bottom of the cell, lowering the utilization efficiency of the oxide.

EXAMPLE 2

A rare earth(dysprosium)-iron alloy, 1.04 kg, with an average composition, 90% of rare earth metals consisting substantially of dysprosium and 10% of iron was obtained by way of the undermentioned electrolysis operation.

A lining of iron was applied inside a container of graphite crucible in the cell. An alloy receiver of molybdenum was placed in the middle portion of the bottom of the graphite crucible. A mixture substantially consisting of dysprosium fluoride and lithium fluoride, as the electrolyte bath, was electrolyzed at an average temperature 970° C. in an inert gas atmosphere. A single rod-like vertical iron cathode with 12 mmϕ was arranged in the similar manner as in Example 1. Four of rod-like vertical graphite anodes with 40 mmϕ were used just like in Example 1.

The raw material of dysprosium fluoride was continuously supplied into the bath during the electrolysis operation of 8 hours under the conditions in Table I. The process progressed satisfactorily, and the produced rare earth(dysprosium)-iron alloy was reserved in the molybdenum receiver, having dripped thereinto one after another during the operation. The alloy could be siphoned in a liquid state as in Example 1.

The electrolysis results and the analysis results of the produced alloy are shown respectively in Table I and Table II.

TABLE I

| | Example 1 | Example 2 |
|---|---|---|
| Current (A) | 100 | 100 |
| Time (hr) | 16 | 8 |
| Conditions for Electrolysis | | |
| $DyF_3$ (wt %) | 60–80 | 50–70 |
| LiF (wt %) | 20–40 | 30–50 |
| Temperature (°C.) | 875–905 | 956–980 |
| Anode Current Density (A/cm$^2$) | 0.2–0.7 | 0.5–2.0 |
| Cathode Current Density (A/cm$^2$) | 3.0–77.1 | 1.0–30.0 |
| Electrolysis Results | | |
| Average Voltage (V) | 7.8 | 7.6 |
| Current Efficiency (%) | 60 | 58 |
| Produced Alloy Weight (kg) | 2.11 | 1.04 |
| Alloy TRE Content (%)* | 92 | 90 |

*TRE Content means a total content of all the rare earth metals of the produced alloy. The rare earth metals includes dysprosium for the most part, together with about 1% of other rare earth traces that are inevitably contained in ordinary industrial materials.

TABLE II

| Examples | Major Components TRE* (%) | Major Components Fe (%) | Impurities Ca (%) | Impurities Mg (%) | Impurities Al (%) | Impurities C (%) | Impurities O (%) |
|---|---|---|---|---|---|---|---|
| Example 1 | 92 | 8 | <0.01 | 0.03 | 0.03 | 0.03 | 0.01 |
| Example 2 | 90 | 10 | <0.01 | 0.04 | 0.05 | 0.04 | 0.04 |

*TRE Content means a total content of all the rare earth metals in the produced alloy. The rare earth metals include dysprosium for the most part, together with about 1% of other rare earth traces that are inevitably contained in ordinary industrial materials.

In this invention, as can be evidently observed in Table 1 and Table II, dysprosium-iron alloys richly containing dysprosium can be produced easily through electrolysis operation of dysprosium fluoride and only in one step. It is also clearly recognized in these tables, that the dysprosium-iron alloys produced in the invented method contain little impurities which are known to have the detrimental effect on the properties of the produced alloys. The numerical figures of compositions shown in Table II were averages of the analysis values of the alloys which have been recovered at the end of each eight-hour interval, respectively With regard to the two Examples 1 and 2, it is easy to continue the experiments longer exceeding the time durations shown in Table I, and similar results to those tabulated in the Tables have been ascertained even in the said elongated experiment.

EXAMPLE 3

A rare earth-iron alloy (RE-Fe), 2.26 kg, with an average composition of 85% by weight of rare earth metals including neodymium and dysprosium for the most part and 15% by weight of iron was obtained by the following process.

An electrolyte bath made substantially of three fluorides, i.e., neodymium fluoride, dysprosium fluoride and lithium fluoride was electrolyzed, at an average temperature 830° C., in an inert gas atmosphere with an electrowinning cell similar to that shown in FIG. 2. As the cell, was used a graphite crucible which is lined by a lining member made of a ferrous material resistive to the bath. An alloy receiver made of molybdenum was placed in the middle portion of the bottom of the graphite crucible. A single wire-like vertical iron cathode with 12 mmϕ was immersed in the bath in the middle portion of the graphite crucible, while four of rod-like vertical graphite anodes with 40 mmϕ were immersed in the bath in a concentrical (in the plane view) arrangement around the single cathode.

A powder mixture of neodymium fluoride and dysprosium fluoride as the raw materials was continuously supplied so as to maintain the electrolysis operation for 16 hours under the operation conditions shown in Table III. All the time during this operation, the electrolysis was satisfactorily continued, wherein produced liquid rare earth(neodymium and dysprosium)-iron alloy dripped one by one to be collected in the molybdenum receiver placed in the bath. The alloy was siphoned from the cell once every eight hours with a vacuum suction type alloy siphoning system having a nozzle.

The electrolysis results and the analysis results of the obtained alloy are shown in Table III and Table IV, respectively. Values of current efficiency in Table III were determined as follows; first, a quantity of electricity that is theoretically required for an electrolytic reduction effected was calculated based on the weight and composition of the alloy obtained, and next a value of current efficiency was determined as the ratio of the theoretical quantity of electricity to a quantity of electricity experimentally consumed.

EXAMPLE 4

A rare earth(neodymium and dysprosium)-iron alloy, 2.42 kg, with an avarage composition, 90% or rare earth metals including neodymium and dysprosium for the most part and 10% of iron was obtained by way of the undermentioned electrolysis operation.

A lining of iron was applied inside a container of graphite crucible in the cell. An alloy receiver of molybdenum was placed in the middle portion of the bottom of the graphite crucible. A mixture substantially consisting of four fluorides, i.e., neodymium fluoride, dysprosium fluoride, lithium fluoride and barium fluoride, as the electrolyte bath, was electrolyzed at an average temperature 867° C. in an inert gas atmosphere. A single rod-like vertical iron cathode with 12 mmϕ was arranged in the similar manner as in Example 3. Four of rod-like vertical graphite anodes with 40 mmϕ were used just like in Example 3.

The raw materials, a mixture of 90% of neodymium fluoride and 10% of dysprosium fluoride, were continuously supplied into the bath during the electrolysis operation of 16 hours under the conditions in Table III. The process progressed satisfactorily, and the produced rare earth(neodymium and dysprosium)-iron alloy was reserved in the molybdenum receiver, having dripped thereinto one after another during the operation. The alloy could be siphoned in a liquid state as in Example 3.

The electrolysis results and the analysis results of the produced alloy are shown respectively in Table III and Table IV.

EXAMPLE 5

A rare earth(neodymium and dysprosium)-iron alloy, 1.06 kg, with an average composition, 90% of rare earth metals including neodymium and dysprosium for the most part and 10% of iron was obtained by way of the undermentioned electrolysis operation.

A lining of iron was applied inside a container of graphite crucible in the cell. An alloy receiver of molybdenum was placed in the middle portion of the bottom of the graphite crucible. A mixture substantially consisting of four fluorides, i.e., neodymium fluoride, dysprosium fluoride, lithium fluoride and barium fluoride, as the electrolyte bath, was electrolyzed at the average temperature 875° C. in an inert gas atmosphere. A single rod-like vertical iron cathode with 12 mmϕ was arranged in the similar manner as in Example 3. Four of rod-like vertical graphite anodes with 40 mmϕ were used just like in Example 3.

The raw materials, a powder mixture of 82% of neodymium fluoride and 18% of dysprosium fluoride, were continuously supplied into the bath during the electrolysis operation of 8 hours under the conditions in Table III. The process progressed satisfactorily, and the produced rare earth(neodymium and dysprosium)-iron alloy was reserved in the molybdenum receiver, having dripped thereinto one after another during the operation. The alloy could be siphoned in a liquid state as in Example 3.

The electrolysis results and the analysis results of the produced alloy are shown respectively in Table III and Table IV.

EXAMPLE 6

A rare earth(neodymium and dysprosium)-iron alloy, 1.35 kg, with an average composition, 91% of rare earth metals including neodymium and dysprosium for the most part and 9% of iron was obtained by way of the undermentioned electrolysis operation.

A lining of iron was applied inside a container of graphite crucible in the cell. An alloy receiver of molybdenum was placed in the middle portion of the bottom of the graphite crucible. A mixture substantially consisting of four fluorides, i.e., neodymium fluoride, dysprosium fluoride, lithium fluoride and barium fluoride, as the electrolyte bath, was electrolyzed at an average temperature 937° C. in an inert gas atmosphere. A single rod-like vertical iron cathode with 6 mmϕ was arranged in the similar manner as in Example 3. Four of rod-like vertical graphite anodes with 40 mmϕ were used just like in Example 3.

The raw materials, a powder mixture of 2% of neodymium fluoride and 98% of dysprosium fluoride, were continuously supplied into the bath during the electrolysis operation of 8 hours under the conditions in Table III. The process progressed satisfactorily, and the produced rare earth(neodymium and dysprocium)-iron alloy was reserved in the molybdenum receiver, having dripped thereinto one after another during the operation. The alloy could be siphoned in a liquid state as in Example 3.

The electrolysis results and the analysis results of the produced alloy are shown respectively in Table III and Table IV.

TABLE III

| | | Example 3 | Ex 4 | Ex 5 | Ex 6 |
|---|---|---|---|---|---|
| Current (A) | | 100 | 100 | 100 | 100 |
| Time (hr) | | 16 | 16 | 8 | 8 |
| Conditions for Electrolysis | | | | | |
| Composition of Bath | $NdF_3$ (wt %) | 61 | 54 | 49 | 1 |
| | $DyF_3$ (wt %) | 1 | 6 | 11 | 59 |
| | LiF (wt %) | 38 | 25 | 25 | 25 |
| | $BaF_3$ (wt %) | — | 15 | 15 | 15 |
| Temperature (°C.) | | 800–845 | 850–886 | 861–901 | 897–1010 |
| Anode Current Density ($A/cm^2$) | | 0.05–0.26 | 0.05–0.50 | 0.27–0.40 | 0.1–2.0 |
| Cathode Current Density ($A/cm^2$) | | 1.0–11.8 | 2.6–53.0 | 2.1–27.0 | 2.5–79.5 |
| Electrolysis Results | | | | | |
| Average Voltage (V) | | 9.5 | 9.4 | 9.0 | 8.5 |
| Current Efficiency (%) | | 67 | 75 | 65 | 76 |
| Produced Alloy | Weight (kg) | 2.26 | 2.42 | 1.06 | 1.35 |
| | TRE Content (%)* | 85 | 90 | 90 | 91 |

*TRE Content means a content of Nd plus a content of Dy.

TABLE IV

| Examples | Major Components TRE* (%) | Nd (%) | Dy (%) | Fe (%) | Impurities Ca (%) | Al (%) | Si (%) | O (%) | C (%) |
|---|---|---|---|---|---|---|---|---|---|
| Ex 3 | 85 | 84 | 1 | 15 | <0.01 | 0.01 | 0.02 | <0.01 | 0.02 |
| Ex 4 | 90 | 80 | 10 | 10 | <0.01 | 0.02 | 0.02 | <0.01 | 0.03 |
| Ex 5 | 90 | 72 | 18 | 10 | <0.01 | 0.02 | 0.02 | <0.01 | 0.02 |
| Ex 6 | 91 | 1 | 90 | 9 | <0.01 | 0.03 | 0.04 | <0.01 | 0.04 |

*TRE Content is a content of Nd plus a content of Dy.

As can be evidently observed in Table III and Table IV, neodymium-dysprosium-iron alloys richly containing neodymium and dysprosium can be produced easily through electrolysis operation of neodymium fluoride and dysprosium fluoride, only in one step. It is also clearly recognized in these tables, that the neodymium-dysprosium-iron alloys produced in the invented method contain little impurities which are known to have the detrimental effect of the properties of the produced alloys. The numerical figures of compositions shown in Table IV are averages of the analysis values of the alloys which have been recovered at the end of each eight-hour interval, respectively.

With regard to Examples 3 through 6, it is easy to continue the experiments longer exceeding the time durations shown in Table III, and similar results to those tabulated in the Tables have been ascertained even in the said elongated experiment.

What is claimed is:

1. A process of producing a dysprosium-iron alloy, comprising the steps of:

preparing a bath of molten electrolyte which has a composition consisting essentially of 20–95% by weight of dysprosium fluoride, 5–80% by weight of lithium fluoride, up to 40% by weight of barium fluoride and up to 20% by weight of calcium fluoride;

effecting electrolytic reduction of said dysprosium fluoride in said bath of molten electrolyte, with at least one iron cathode and at least one carbon anode, so as to electrodeposit dysprosium on said at least one iron cathode, and alloying the electrodeposited dysprosium with iron of said at least one iron cathode so as to produce said dysprosium-iron alloy in a liquid state on said at least one iron cathode;

adding said dysprosium fluoride to said bath of molten electrolyte so as to maintain said composition of the bath of molten electrolyte, for compensating for consumption of the dysprosium fluoride during production of said dysprosium-iron alloy;

dripping the liquid dysprosium-iron alloy from said at least one iron cathode into a receiver having a mouth which is open upward in a lower portion of the bath of molten electrolyte below said at least one iron cathode, and thereby collecting said liquid dysprosium-iron alloy in the form of a molten pool in said receiver; and withdrawing said molten pool of the liquid dysprosium-iron alloy from said receiver.

2. A process according to claim 1, wherein said balt of molten electrolyte is held at temperatures within a range of 870°–1000° C., and said electrolytic reduction is effected at said temperatures.

3. A process according to claim 1, wherein said electrolytic reduction is effected by applying a direct current to said at least one carbon anode with a current density of 0.05–4.0 A/cm$^2$, and to said at least one iron cathode with a current density of 0.50–80 A/cm$^2$.

4. A process according to claim 1, wherein said at least one carbon anode is made of graphite.

5. A process according to claim 1, wherein said at least one iron cathode is an elongate solid member having a substantially constant transverse cross sectional shape over its length.

6. A process according to claim 1, wherein said at least one iron cathode is an elongate tubular member having a substantially constant transverse cross sectional shape over its length.

7. A process according to claim 1, wherein said bath of electrolyte containing said dysprosium compound consists essentially of at least 25% by weight of dysprosium fluoride and at least 15% by weight of lithium fluoride.

8. A process of producing a neodymium-dysprosium-iron alloy, comprising the steps of:

preparing a bath of molten electrolyte which has the chemical composition consisting essentially of 20–95% by weight of mixture of neodymium fluoride and dysprosium fluoride, 5–80% by weight of lithium fluoride, up to 40% by weight of barium fluoride and up to 20% by weight of calcium fluoride;

effecting electrolytic reduction of said neodymium fluoride and said dysprosium fluoride in said bath of molten electrolyte, with at least one iron cathode and at least one carbon anode, so as to electrodeposit neodymium and dysprosium on said at least one iron cathode, and alloying the electrodeposited neodymium and dysprosium with iron of said at least one iron cathode so as to produce said neodymium-dysprosium-iron alloy in a liquid state on said at least one iron cathode;

adding said mixture of neodymium fluoride and dysprosium fluoride to said bath of molten electrolyte so as to maintain said chemical composition of the bath of molten electrolyte, for compensating for consumption of the neodymium fluoride and the dysprosium fluoride during production of said neodymium-dysprosium-iron alloy;

dripping the liquid neodymium-dysprosium-iron alloy from said at least one iron cathode into a receiver having a mouth which is open upward in a lower portion of the bath of molten electrolyte below said at least one iron cathode, and thereby collecting said liquid neodymium-dysprosium-iron alloy in the form of a molten pool in said receiver; and withdrawing said molten pool of the liquid neodymium-dysprosium-iron alloy from said receiver.

9. A process according to claim 8, wherein said bath of molten elctrolyte is held at temperatures within a range of 800°–1010° C., and said electrolytic reduction is effected at said temperatures.

10. A process according to claim 8, wherein said electrolytic reduction is effected by applying a direct current to said at least one carbon anode with a current density of 0.05–4.0 A/cm$^2$, and to said at least one iron cathode with a current density of 0.50–80 A/cm$^2$.

11. A process according to claim 8, wherein said at least one carbon mode is made of graphite.

12. A process according to claim 8, wherein said at least one iron cathode is an elongate solid member having a substantially constant transverse cross sectional shape over its length.

13. A process according to claim 8, wherein said at least one iron cathode is an elongate tubular member having a substantially constant transverse cross sectional shape over its length.

14. A process according to claim 8, wherein said bath of electrolyte containing said neodymium fluoride and said dysprosium fluoride consists essentially of at least 25% by weight of said mixture of neodymium fluoride and dysprosium fluoride and at least 15% by weight of lithium fluoride.

* * * * *